US005558285A

United States Patent [19]

Räsänen

[11] Patent Number: 5,558,285

[45] Date of Patent: Sep. 24, 1996

[54] APPARATUS FOR LIFTING AND DROPPING A DROP HAMMER

[75] Inventor: Pentti Räsänen, Savonlinna, Finland

[73] Assignees: Oy Aura-Machine Ltd., Aura; Savonlinnan PR-Urakointi OY, Savonlinna, both of Finland

[21] Appl. No.: 436,231

[22] PCT Filed: Dec. 21, 1993

[86] PCT No.: PCT/FI93/00549

§ 371 Date: May 17, 1995

§ 102(e) Date: May 17, 1995

[87] PCT Pub. No.: WO94/14539

PCT Pub. Date: Jul. 7, 1994

[30] Foreign Application Priority Data

Dec. 21, 1992 [FI] Finland ..... 925798

[51] Int. Cl.[6] ..... B02C 1/14

[52] U.S. Cl. ..... 241/273; 241/283

[58] Field of Search ..... 241/273, 283; 173/89

[56] References Cited

U.S. PATENT DOCUMENTS

| | | | |
|---|---|---|---|
| 762,874 | 6/1904 | Black . | |
| 1,579,330 | 4/1926 | Long et al. | 241/273 |
| 1,703,127 | 2/1929 | Vial et al. | 241/273 |
| 1,719,278 | 7/1929 | Powell . | |
| 2,646,225 | 7/1953 | Te Desco . | |
| 3,743,030 | 7/1973 | Gifford . | |

FOREIGN PATENT DOCUMENTS

| | | | |
|---|---|---|---|
| 21988 | 9/1947 | Finland . | |
| 2120517 | 3/1980 | Germany | 173/89 |
| 60-0195226 | 10/1985 | Japan | 173/89 |
| 223278 | 10/1965 | Sweden . | |
| 0746040 | 7/1980 | U.S.S.R. | 173/89 |

*Primary Examiner*—John M. Husar
*Attorney, Agent, or Firm*—Nixon & Vanderhye P.C.

[57] ABSTRACT

An apparatus for lifting and dropping a drop hammer in a crushing or compaction process allows the drop hammer to fall completely freely, without being retarded by an attached cable or other element, and allows the height to which the hammer is lifted to be infinitely adjusted, i.e. to virtually any position. The drop hammer moves vertically, up and down, within a hollow cylinder and has a latch engaging head on an upper portion. An anchoring device is disposed within the cylinder and is distinct from the drop hammer and cylinder, and includes first and second latches which are movable by an actuator (such as a hydraulic cylinder) to engage or disengage the drop hammer head. The latches are typically mounted between top and bottom generally horizontal plates, and are pivotally connected adjacent one end to the plates and adjacent another end to the actuator. Crank blocks and a synchronizing lever may be provided. At least one cable connected to a pulley or winch at the top of the cylinder moves the anchoring device up and down, and one or more hydraulic hoses feeding the actuator (where a hydraulic cylinder) may be reeled separately from the cable.

19 Claims, 4 Drawing Sheets

APPARATUS FOR LIFTING AND DROPPING A DROP HAMMER

CROSS-REFERENCE TO RELATED APPLICATION

This is the U.S. national phase of International Application No. PCT/FI93/00549.

BACKGROUND AND SUMMARY OF THE INVENTION

The present patent application relates to an apparatus for lifting and dropping a drop hammer to be used in a crushing or compaction process, comprising a vertical cylinder, in which said drop hammer is lifted and dropped;

winch equipment and cables connected thereto for lifting said drop hammer;

a quick-release anchoring device for fastening said drop hammer to the cables of the winch.

The apparatuses already known, as the apparatuses disclosed in patent applications FI 853869 and DE 2120517 have the problem of having a lift cable stationarily attached to the drop hammer, which cable again slows down the free drop of said drop hammer and is easily worn out. Moreover, the energy required for the acceleration of the cable reel reduces the efficiency of the apparatus. The problem with these apparatuses is also that the cable reel rolls even after the drop hammer has reached the bottom. The rolling causes excessive loosening of the cable on the reel, slowing down the next lift. The loose cable rolls unevenly on the reel wearing thus quickly out (ripping up).

In the previous hammering apparatuses, the hammering of pipes and piles has been arranged by freely dropping drop hammers which are released either mechanically or by pulling on a rope. The mechanically releasable drop hammer must, as becomes apparent in Swedish patent SE 223 278, always be lifted to a certain predetermined height for dropping, whereby the dropping height and the dropping power in these apparatuses may not be adjusted.

The hammering apparatuses, in which the drop hammers are dropped by pulling on a rope, as in apparatuses disclosed in Finnish patent FI 21988 and U.S. Pat. No. 3,743,030 are slow and require a person next to the machine to release the drop hammer for the free drop, which may be both unpleasant and dangerous.

Apparatuses allowing the free drop and being durable and light enough for lifting and dropping the drop hammer have so far not occurred in the market.

A characterizing feature of an apparatus for lifting and dropping a drop hammer in accordance with the present invention for solving the above described problems is that the quick-release anchoring device therein comprises latches that may be hydraulically falling into catch around a bolt mounted on top of the drop hammer, for the lift and released for the free drop of said drop hammer.

By using the apparatus in accordance with the invention it is possible to arrange the dropping of the drop hammer to hydraulically take place from a working machine. By using the apparatus in accordance with the invention it is even possible to lift and drop a large drop hammer.

BRIEF DESCRIPTION OF THE DRAWINGS

The present invention is described more in detail, by way of example, with reference to the accompanying drawings, in which FIG. 1 schematically illustrates a partly sectional, vertical view of an apparatus in accordance with the present invention.

DETAILED DESCRIPTION OF THE DRAWINGS

Figure 1:
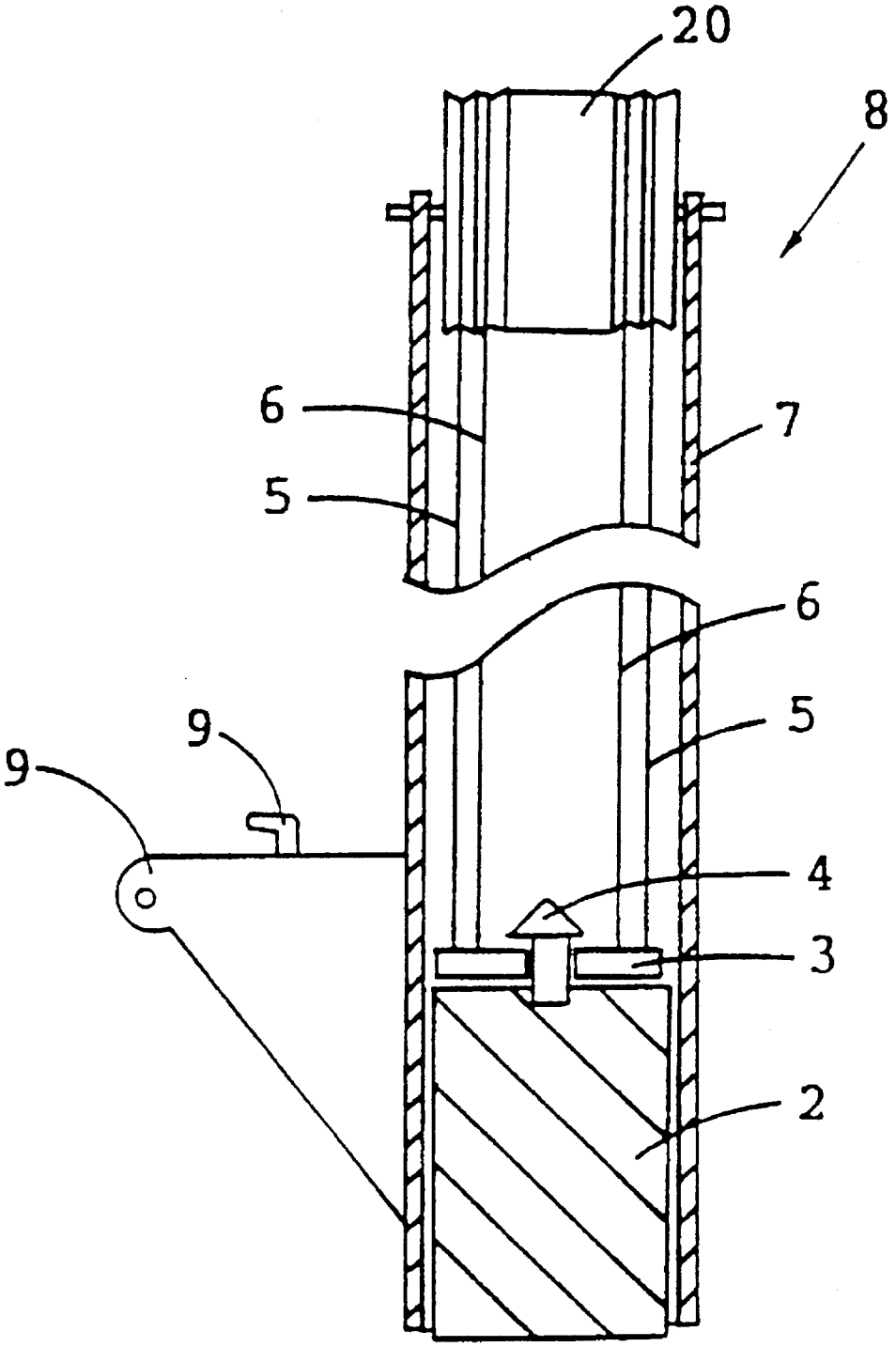

FIG. 1 illustrates an apparatus in accordance with the present invention for lifting and dropping a drop hammer 2 manufactured of cast steel. The apparatus comprises an oblong cylinder 7 manufactured of steel, in which cylinder said drop hammer is lifted and dropped, and winch equipment with cables 6. In an apparatus disclosed in FIG. 1 the cylinder is provided with quick-release lugs 9 for mounting the apparatus to a working machine.

The apparatus in accordance with the present invention also comprises a quick-release anchoring device 3 mounted to the lower ends of two cables. When using the apparatus said drop hammer is fastened to said quick-release anchoring device 3 by lowering said quick-release anchoring device on top of said drop hammer 2 and by hydraulically fastening said quick-release anchoring device to said drop hammer, whereafter said drop hammer is lifted up by means of winch equipment 8 and cables 6. At an upper level the quick-release anchoring device 3 is hydraulically opened or released, whereby the drop hammer freely drops down.

Figure 2:
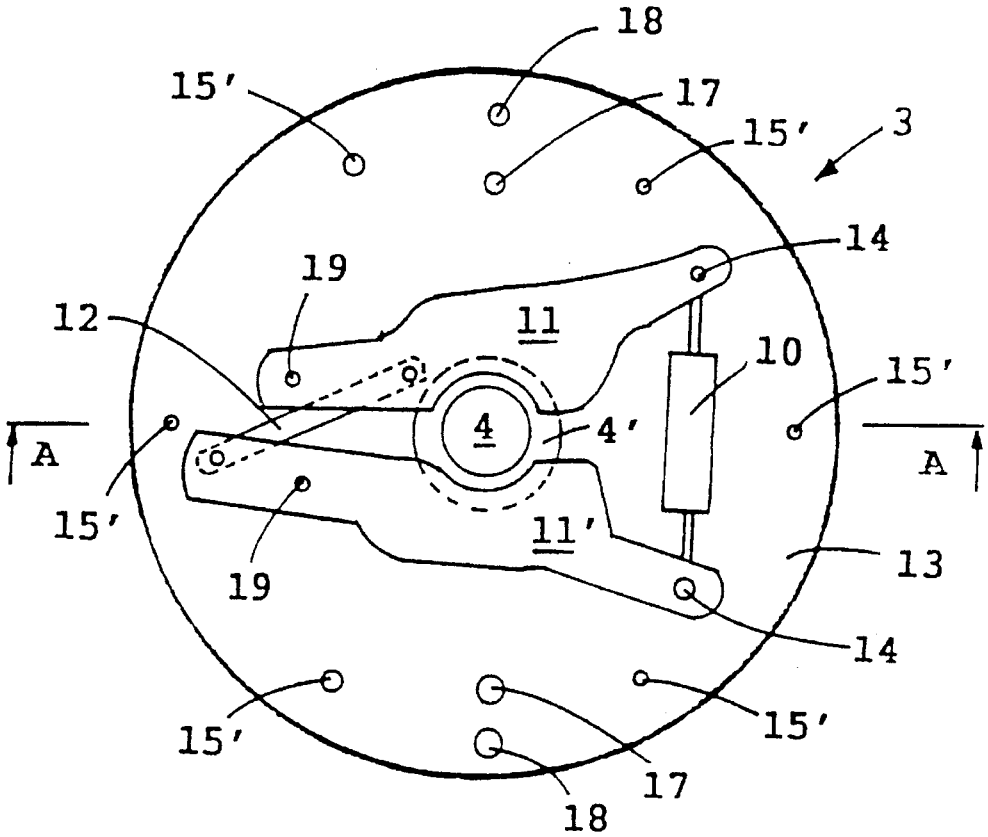
FIG. 2 schematically illustrates a top view of a quick-release anchoring device of an apparatus in accordance with the present invention.
Figure 3:
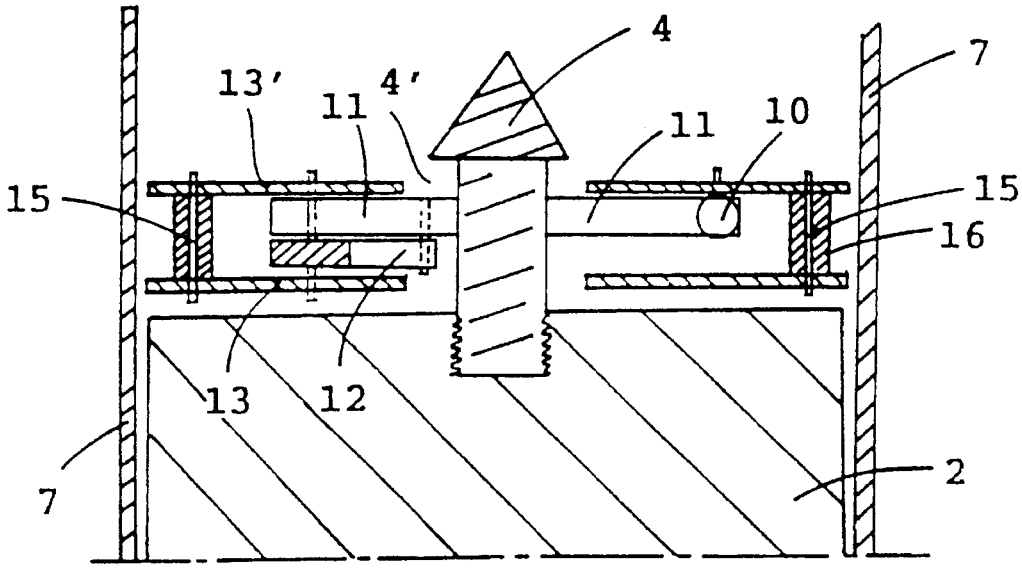
FIG. 3 schematically illustrates a cross-sectional view along line AA of a quick-release anchoring device in accordance with FIG. 2 arranged to the lifting and dropping apparatus in accordance with the present invention.

The quick-release anchoring device 3 is illustrated more closely in FIGS. 2 and 3. The quick-release anchoring device comprises a bottom plate 13 and a cover plate 13', which are connected to each other by means of bolts 15 and sleeves 16. FIG. 2 illustrates a top view of the quick-release anchoring device, the cover plate 13', bolts 15 and sleeves 16 being excluded from the drawing. Mounting points 15' are indicated in the drawing. Latches 11, 11', which may be fastened and released, are arranged between the plates 13, 13'. The latches are at one end connected by bearing pivots 19 to the plates 13, 13'. Further, a connecting bar 12 is attached to this end of the latches to ensure the synchronous movement of the latches.

A hydraulic cylinder 10 is arranged to the other end of the latches 11, 11' between the plates 13, 13', fastening and releasing the latches pivoted by means of pivots 19. The synchronous release of both halves 11, 11' of the latch is ensured by the connecting bar 12.

The centers of the bottom and cover plates 13, 13' have an opening 4'. When using the apparatus the quick-release anchoring device 3, i.e. the fastening and releasing apparatus, is lowered on top of the drop hammer 2 in such a way that the bolt or pivot 4 attached to the top of the drop hammer hits the opening 4' in the quick-release anchoring device 3. The latches 11, 11' are fastened by means of hydraulic pressure, i.e. the hydraulic cylinder 10, around the bolt 4, whereafter the drop hammer 2 is lifted up with winch equipment 8. At an upper level the latches 11, 11' are released by hydraulic pressure and the drop hammer 2 may freely drop down.

The hydraulic pressure is led through hydraulic hoses 5 to the hydraulic cylinder 10, which are led to the quick-release anchoring device 3 via a reel 20 of the winch equipment 8 and attached to mounting points 18 therein. The cables are respectively attached to the mounting points 17 of the quick-release anchoring device.

Figure 4:
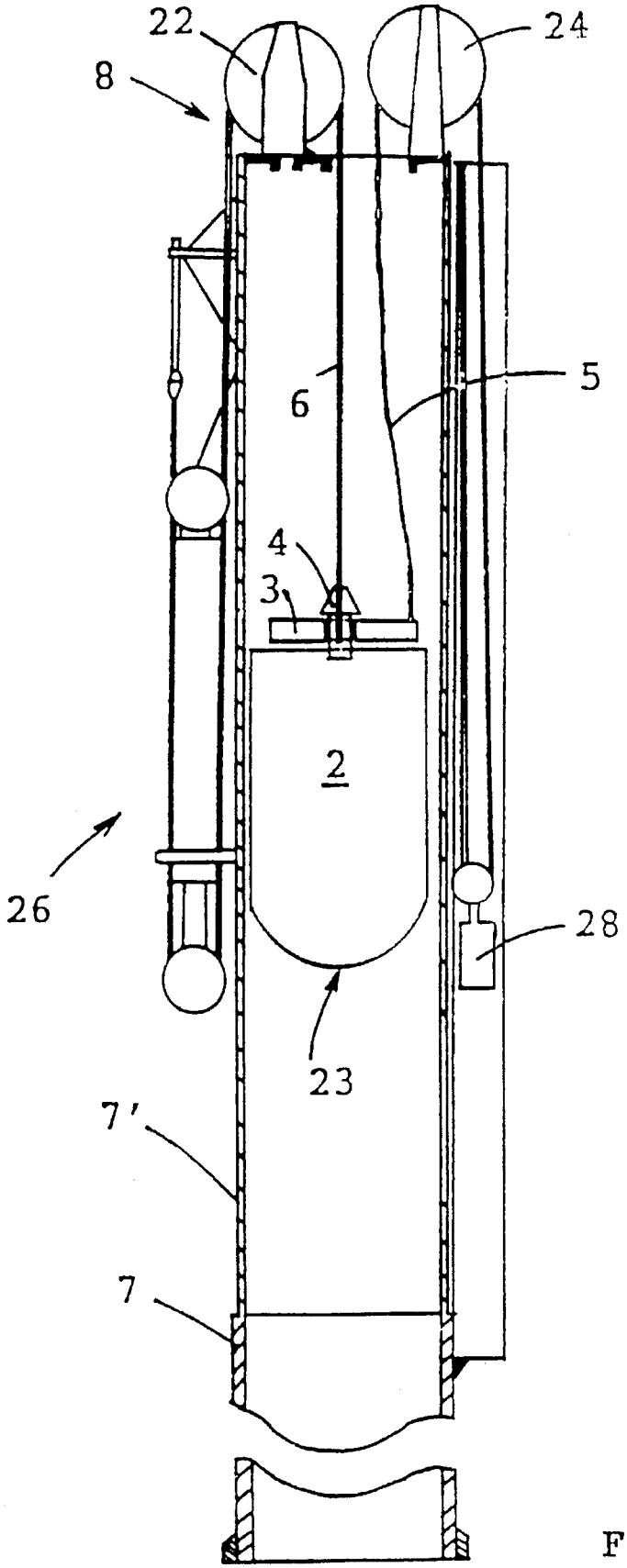
FIG. 4 schematically illustrates a second apparatus in accordance with the present invention for lifting and dropping a drop hammer.

FIG. 4 illustrates a second apparatus in accordance with the present invention for lifting and dropping a drop hammer, which apparatus is provided with separate reels 22 and 24 for reeling the cables 6 of the winch equipment and for reeling the hydraulic hose 5, respectively. The drawing illustrates a situation, in which the cable 6 is lifting the drop hammer 2 upwards. The winch equipment 26 arranged outside the drop cylinder 7' draws the cable upwards via the reel 22. Respectively, a weight 28 arranged to the cover duct 27 outside the drop cylinder 7' draws with its weight the hydraulic hose 5 upwards via the reel 24. By utilizing separate reels for reeling the cable and the hydraulic hose it is possible to optimize the reeling process for both materials being reeled.

Although FIG. 4 illustrates only one lifting cable 6, the apparatus has two cables, one on both sides of the pivot 4. The cables may be cables being reeled side by side on the same reel, as disclosed in FIG. 1, or cables being reeled on two separate neighbouring reels.

Figure 5:
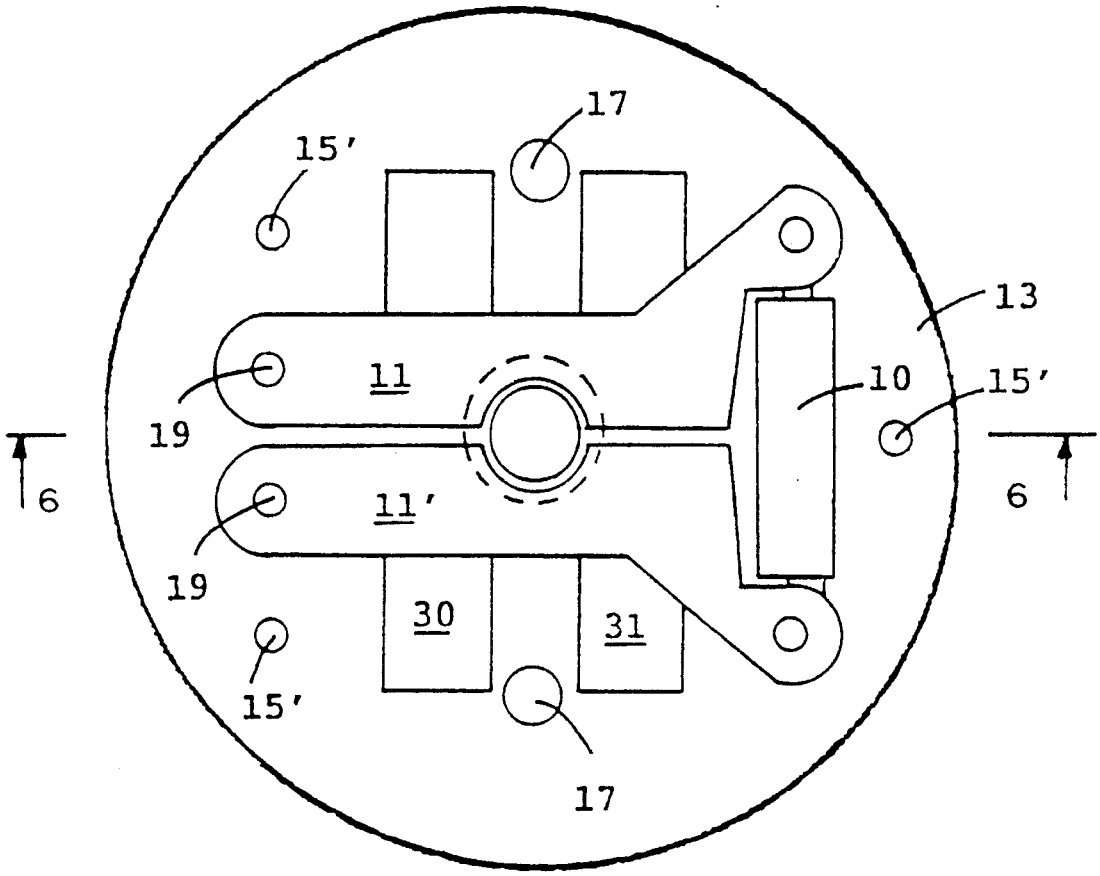
FIG. 5 schematically illustrates a top view of a second quick-release anchoring device in accordance with the present invention.
Figure 6:
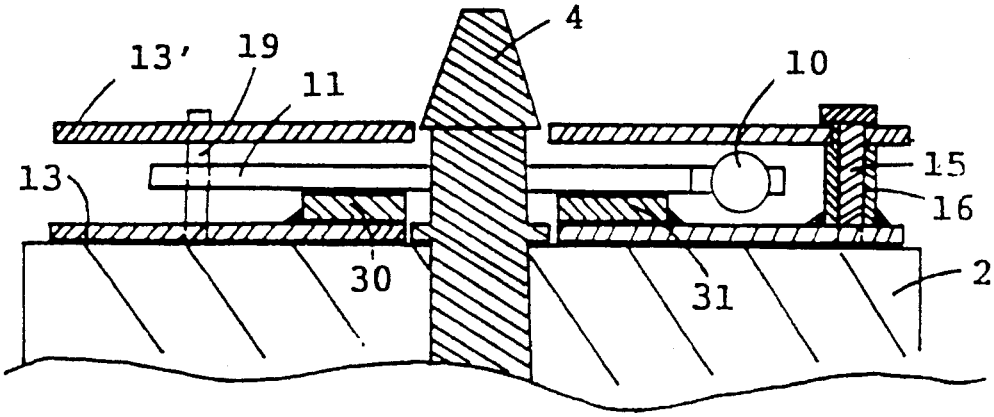
FIG. 6 schematically illustrates a cross-sectional view along line AA of a quick-release anchoring device in accordance with FIG. 5 arranged to the lifting and dropping apparatus in accordance with the present invention.

FIG. 5 and 6 illustrate a second quick-release anchoring device similar to FIGS. 2 and 3. FIG. 5 illustrates the bottom plate 13 and the latch mechanism of the quick-release anchoring device seen from the top and having the cover plate removed. FIG. 6 illustrates a cross-sectional view of the quick-release anchoring device having the latch mechanism fastened to the bolt 4 of the drop hammer 2. The bottom and the cover plates 13, 13' are shown in the drawing.

The bottom and cover plates are connected to each other by means of bolts 15 and sleeves 16. The locations 15' of the bolts 15 and the attaching points 17 of the cables are indicated on the bottom plate in FIG. 5

The latches 11, 11' arranged between the bottom plate 13 and the cover plate 13' are connected from one end by means of pivots 19 to the plates 13, 13'. From the other end the latches are connected to each other by a hydraulic cylinder 10, which fastens and releases the latches. A connecting bar, as in the arrangement disclosed in FIG. 2, is not required for ensuring the releasing of both latches, if the release movement caused by the hydraulic cylinder is greater than the maximal path of movement of one latch. The movement of the hydraulic cylinder automatically forces also the other latch to move at least when the first moved latch has reached the maximal release position.

In the arrangement of FIGS. 5 and 6 crank blocks 30 and 31 are arranged between the bottom plate and the latches 11, 11' preventing said latches from seizing on the bottom plate 13 when lifting the heavy drop hammer.

The apparatus in accordance with the present invention is applicable for crushing so called problem wastes difficult to crush and bringing them for utilization.

Due to the cylindrical outer casing the apparatus in accordance with the present invention may be readily and accurately positioned on top of the material to be crushed or compacted. The striking force of the drop hammer may be accurately directed to the desired place. Due to the hydraulic release mechanism the striking force may be adjusted by adjusting the drop height.

The bottom or the lower surface 23 of the drop hammer (FIG. 4) is to be preferably slightly convex, almost planar, whereby the striking force of the drop hammer causes the crushing of the material and not splitting, as when using a wedge-shaped drop hammer. Wedge-shaped drop hammers or like are generally used in the crushing. This causes the splitting of the material to be crushed and spreading of the chips all over. By using a drop hammer with a rounded bottom in the crushing the force is more evenly directed downwards and not sideways and the liability of the material to be crushed to fly sideways considerably decreases.

The apparatus in accordance with the present invention may be applied, for example, in the metallurgical industry for crushing slag. The waste generating in the smelting processes, the slag, which still often contains a lot of iron (40–80%) and other valuable metals, solidifies to very hard large slag blocks, the recrushing of which for smelting or other utilization is apparently very expensive. That is why the slag is often left unused, which the ever growing mountains of slag indicate. By utilizing the apparatus in accordance with the present invention the slag may, however, now be readily and economically crushed to be suitable for smelting or other utilization.

It is also often difficult and expensive to bring scrap of large size to a form, which may be reutilized. Large sized scrap is usually flame-cut into smaller pieces before resmelting. It is, however, possible by utilizing the apparatus in accordance with the present invention to quickly and simply treat, for example, rolls and cylinders of a paper machine to such a form that the material in them may be utilized.

It would often be necessary in quarries for commercial stone to be able to crush the defective or otherwise inappropriate, unused blocks for utilization. The apparatus in accordance with the present invention may especially well be applied for crushing such stone material as well as removed concrete material. When crushed the stone material may be utilized, for example, for the manufacture of tiles.

The apparatus in accordance with the present invention, which may readily be transferred from one place to another and the striking force of which may readily be adjusted, may well be applied, for example, for the compaction in earth work.

It is not the intention to limit the present invention to the application examples given above, but it is intended to be widely applicable, in addition to crushing, within the scope of invention defined by the accompanying patent claims.

I claim:

1. Apparatus for lifting and dropping a drop hammer in a crushing or compaction process, comprising:

a hollow cylinder having an interior substantially vertical surface;

a drop hammer movable vertically, up and down, within said hollow cylinder, said drop hammer having an upper portion including a latch-engaging head;

an anchoring device disposed within said cylinder distinct from said drop hammer and hollow cylinder and comprising: first and second latches with portions thereof which engage said latch-engaging head; and an actuator for movement between a first position in which one or both of said latches are moved with respect to said latch-engaging head to engage said head and effectively attach said anchoring device to said drop hammer so that said drop hammer and anchoring device move together up and down vertically within said cylinder, and a second position in which one or both of said latches are moved away from said latch-engaging head so that said drop hammer is completely detached from said anchoring device and may drop freely within said cylinder under the force of gravity; and at least one cable attached to said anchoring device for movement of said anchoring device vertically up and down within said cylinder.

2. Apparatus as recited in claim 1 further comprising at least one circular element rotatable about a generally horizontal axis and mounted to a top portion of said hollow cylinder, said at least one cable wrapped around at least a portion of said circular element.

3. Apparatus as recited in claim 2 wherein said at least one circular element comprises a winch cylinder mounted to said top portion of said hollow cylinder, said winch cylinder powered about said axis.

4. Apparatus as recited in claim 3 wherein said at least one cable comprises two cables.

5. Apparatus as recited in claim 3 wherein said actuator comprises a hydraulic cylinder supplied with hydraulic fluid by at least one hydraulic fluid hose; and wherein said at least one hydraulic fluid hose is connected to said winch cylinder so that said hydraulic fluid hose is reeled up and let out along with said at least one cable upon rotation of said winch cylinder about its axis.

6. Apparatus as recited in claim 5 wherein said at least one hydraulic fluid hose comprises two hoses.

7. Apparatus as recited in claim 2 wherein said at least one circular element comprises a first pulley mounted to a top portion of said cylinder, about which said at least one cable travels; and further comprising a winch mounted exteriorly of said hollow cylinder to which said cable is connected, for powering said cable about said first pulley.

8. Apparatus as recited in claim 7 further comprising a second pulley mounted to a top portion of said cylinder; and a hose connected to said actuator and movable about a peripheral portion of said second pulley.

9. Apparatus as recited in claim 8 wherein said cable comprises a single cable; and further comprising a weight exterior of said hollow cylinder connected to said hose remote from said second pulley.

10. Apparatus as recited in claim 1 wherein said actuator comprises a hydraulic cylinder supplied with hydraulic fluid by at least one hydraulic fluid hose.

11. Apparatus as recited in claim 10 wherein said anchoring device includes at least a first generally horizontal plate; and wherein first and second latches are pivotally connected at a first portion thereof to said first plate, and pivotally operatively connected at a second portion thereof to said actuator.

12. Apparatus as recited in claim 11 wherein said anchoring device also includes a second generally horizontal plate vertically spaced from said first plate; and wherein said first and second latches are pivotally connected to both said first and second plates.

13. Apparatus as recited in claim 11 further comprising a lever pivotally connected to both said latches adjacent said first portions thereof for ensuring substantially synchronous movement of said latches.

14. Apparatus as recited in claim 11 wherein said first plate is below said latches; and further comprising crank blocks disposed between said first plate and said latches for preventing said latches from seizing on said first plate.

15. Apparatus as recited in claim 1 wherein said drop hammer is of steel and includes a convex bottom surface.

16. Apparatus as recited in claim 1 further comprising quick release lugs connected to said hollow cylinder for mounting said cylinder to a working machine.

17. Apparatus for lifting and dropping a drop hammer in a crushing or compaction process, comprising:

a substantially vertical guide;

a drop hammer movable vertically, up and down, at least in part guided by said vertical guide, said drop hammer having an upper portion including a latch-engaging head; and an anchoring device distinct from said drop hammer and comprising: first and second latches with portions thereof which engage said latch-engaging head; and a hydraulic cylinder for movement between a first position in which said latches are moved with respect to said latch-engaging head to engage said head and effectively attach said anchoring device to said drop hammer so that said drop hammer and anchoring device move together up and down vertically, and a second position in which said latches are moved away from said latch-engaging head so that said drop hammer is completely detached from said anchoring device and may drop freely under the force of gravity.

18. Apparatus as recited in claim 17 wherein said anchoring device includes first and second generally horizontal plates vertically spaced from each other, said first and second latches pivotally connected adjacent a first end thereof to said plates, and pivotally operatively connected to adjacent a second end thereof to said actuator.

19. Apparatus as recited in claim 18 wherein said first plate is below said latches; and further comprising a lever connected to both said latches adjacent said first ends thereof for ensuring substantially synchronous movement of said latches, and crank blocks disposed between said first plate and said latches for preventing said latches from seizing on said first plate.

* * * * *